US005673364A

United States Patent [19]

Bialik

[11] Patent Number: 5,673,364

[45] Date of Patent: Sep. 30, 1997

[54] SYSTEM AND METHOD FOR COMPRESSION AND DECOMPRESSION OF AUDIO SIGNALS

[75] Inventor: Leon Bialik, Rishon LeZion, Israel

[73] Assignee: The DSP Group Ltd., Santa Clara, Calif.

[21] Appl. No.: 160,530

[22] Filed: Dec. 1, 1993

[51] Int. Cl.[6] ..... G10L 3/02

[52] U.S. Cl. ..... 395/2.92; 395/2.91

[58] Field of Search ..... 381/29, 30; 395/2.1, 395/2.14, 2.16, 2.25, 2.28, 2.3, 2.31, 2.32

[56] References Cited

U.S. PATENT DOCUMENTS

| | | | |
|---|---|---|---|
| 4,130,729 | 12/1978 | Gagnon | 395/2.25 |
| 4,140,876 | 2/1979 | Gognon | 395/2.25 |
| 4,752,956 | 6/1988 | Sluijter | 395/2.28 |
| 4,811,396 | 3/1989 | Yatsuzuka | 381/30 |
| 4,847,905 | 7/1989 | Lefevre et al. | 395/2.31 |
| 4,868,867 | 9/1989 | Davidson et al. | 381/36 |
| 4,924,508 | 5/1990 | Crepy et al. | 395/2.16 |
| 4,932,061 | 6/1990 | Kroon et al. | 395/228 |
| 5,020,051 | 5/1991 | Beesley et al. | 370/29 |
| 5,125,030 | 6/1992 | Nomura et al. | 395/2.31 |
| 5,371,853 | 12/1994 | Kao et al. | 395/2.32 |

OTHER PUBLICATIONS

Sadaoki Furui, "*Digital Speech Processing, Synthesis, and Recognition,* "Marcel Dekker, Inc., New York, NY, 1989.

*Primary Examiner*—Allen R. MacDonald
*Assistant Examiner*—Vijay B. Chawan
*Attorney, Agent, or Firm*—Skjerven, Morrill, MacPherson, Franklin & Friel

[57] ABSTRACT

A speech compression/decompression system and method which do not require special hardware are described. The compression unit represents an input audio signal as a collection of parameters, wherein the parameters are a remnant excitation pulse sequence, a set of spectral coefficients and a set of pitch parameters. The decompression unit utilizes the pitch parameters and remnant excitation pulse sequence to produce a reconstructed excitation signal. The decompression unit also utilizes the spectral coefficients to filter the reconstructed excitation signal into a speech waveform. The compression unit includes a short-term predictor, a two-step long-term predictor and a multi-pulse analyzer.

22 Claims, 9 Drawing Sheets

SYSTEM AND METHOD FOR COMPRESSION AND DECOMPRESSION OF AUDIO SIGNALS

FIELD OF THE INVENTION

The present invention relates to speech signal processing.

BACKGROUND OF THE INVENTION

Speech signals are complex and can be broken down into elements of the words spoken, the pitch of intonation and other elements which identify each speaker. Digitizing a speech signal without losing some of the information included therein requires a high sampling rate, typically of 8 KHz. Therefore, a speech signal just a few seconds long typically comprises a large number of samples.

Much effort in the prior art has been expended in trying to compress speech signals so that they can be easily transmitted and stored. The compressed signals, however, must maintain the information in the original speech signals or else their decompressed versions will be unintelligible to the body (human or computer) which hears them. Typically, the compression is done by analyzing the speech signal and only utilizing the "relevant" portions for storage or transmission.

If the body is a computer which receives speech commands and must respond accordingly, the quality of the reproduction or of the analysis must be high or else the computer will be unable to understand the command and, as a result, will respond incorrectly.

As a result of the need for high quality analysis, a large number of analysis methods have been developed, none of which, by themselves, provide the ideal combination of high compression ratio and high quality reproduction. Each of these methods works on a frame of the signal, typically of 80–240 samples long.

Some of these methods are: linear prediction analysis which produces the spectrum of the frame as linear prediction coefficients (LPC), pitch estimation methods which determine the pitch of the speech in the frame, vector quantization methods which code a multiplicity of wave shapes and define the frame as a combination of the predefined wave shapes, and multi-pulse analysis which defines the frame as an empty signal having a pre-determined number of spikes and determines where the spikes exist and what their amplitudes are. These methods, and the many others which are also commonly utilized, are described in the book by Sadaoki Furui, *Digital Speech Processing, Synthesis and Recognition*, Marcel Dekker Inc. New York, N.Y., 1989. This book and the articles in its bibliography are incorporated herein by reference.

In many of the methods, the more datapoints used to describe the frame, the better the analysis. However, the result is not very compressed.

Furthermore, the analysis methods described hereinabove are computation-intensive and typically require special hardware, such as a digital signal processor (DSP) chip, in order to perform in real- or near-real-time. Such a requirement causes speech recognition systems and digital sound reproduction systems to be expensive.

SUMMARY OF THE PRESENT INVENTION

The present invention provides a speech compression/decompression system and method which does not require special hardware.

There is therefore provided, in accordance with an embodiment of the present invention, the system includes an audio signal compression unit for representing an input audio signal as a collection of parameters and a decompression unit for utilizing the pitch parameters and remnant excitation pulse sequence to produce a reconstructed excitation signal and for utilizing the spectral coefficients to filter the reconstructed excitation signal into a speech waveform. The parameters are a remnant excitation pulse sequence, a set of spectral coefficients and a set of pitch parameters.

Additionally, in accordance with the present invention, the decompression unit includes a) a first-in-first-out (FIFO) buffer in which are stored residual excitation signals, b) a selector for utilizing the pitch parameters to reconstruct the reconstructed excitation signal from portions of the stored residual excitation signals, for linearly combining the reconstructed excitation signal with a remnant excitation signal formed at least from the remnant excitation pulse sequence into a residual excitation signal and for providing the residual excitation signal to the FIFO buffer and c) a filter operating with the spectral coefficients to filter the residual excitation signal into the speech waveform. The decompression unit typically additionally includes a buffer control unit for adding the reconstructed excitation signal into the FIFO buffer. The decompression unit additionally includes a post-filter which filters the speech waveform.

Moreover, in accordance with the present invention, the compression unit includes a) a short-term predictor responsive to the input audio signal for determining eight spectral coefficients and for generating a residual signal by utilizing the spectral coefficients to filter out short-term correlations in the input audio signal and b) a two-step long-term predictor, operative on the residual signal, for determining the pitch parameters, wherein the pitch parameters are formed of a rough estimate and a second-order correction, and for generating a remnant signal by utilizing the pitch parameters to filter out long-term correlations in the residual signal. The compression unit typically also includes a multi-pulse analyzer for producing the remnant excitation pulse sequence from the remnant signal. In one embodiment, the multi-pulse analyzer generates seven pulses and a gain to represent the remnant excitation pulse sequence.

Moreover, in accordance with the present invention, the compression unit includes coding means for providing coded versions of the following parameters: the spectral coefficients, the rough pitch estimate, the second-order correction, a gain and the remnant excitation pulse sequence and the decompression unit comprises a decoder for decoding the coded parameters.

There is also provided, in accordance with a second embodiment of the present invention, the system includes a) an audio signal compression unit coupled to an input audio signal and having an remnant excitation pulse sequence output line, a spectral coefficient output line and a pitch parameters output line and b) a decompression unit having an remnant excitation pulse sequence input line, a spectral coefficient input line, a pitch parameters input line and a speech waveform output line.

Additionally, in accordance with the second embodiment, the decompression unit includes a) a first-in-first-out (FIFO) buffer in which are stored residual excitation signals, b) a selector for utilizing the pitch parameters to reconstruct the reconstructed excitation signal from portions of the stored residual excitation signals, for linearly combining the reconstructed excitation signal with a remnant excitation signal formed at least from the remnant excitation pulse sequence into a residual excitation signal and for providing the residual excitation signal to the FIFO buffer and c) a filter operating with the spectral coefficients to filter the residual excitation signal into the speech waveform.

Finally, the method performs the operations of the elements of the system.

BRIEF DESCRIPTION OF THE DRAWINGS AND APPENDICES

The present invention will be understood and appreciated more fully from the following detailed description taken in conjunction with the drawings in which.

DETAILED DESCRIPTION OF A PREFERRED EMBODIMENT

Figure 1:
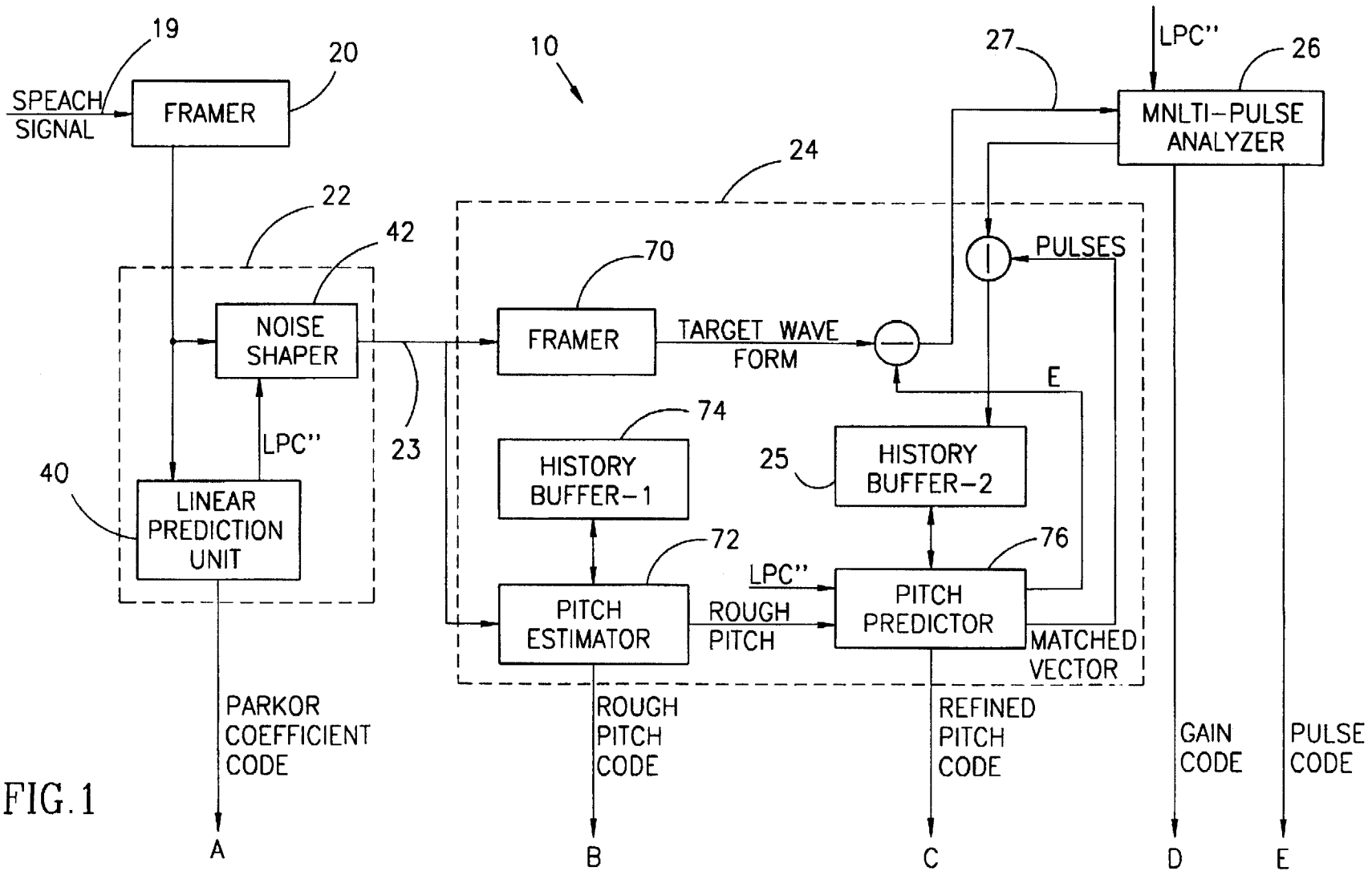
FIG. 1 is a block diagram illustration of a system for speech compression and decompression, constructed and operative in accordance with a preferred embodiment of the present invention.
Figure 1A:
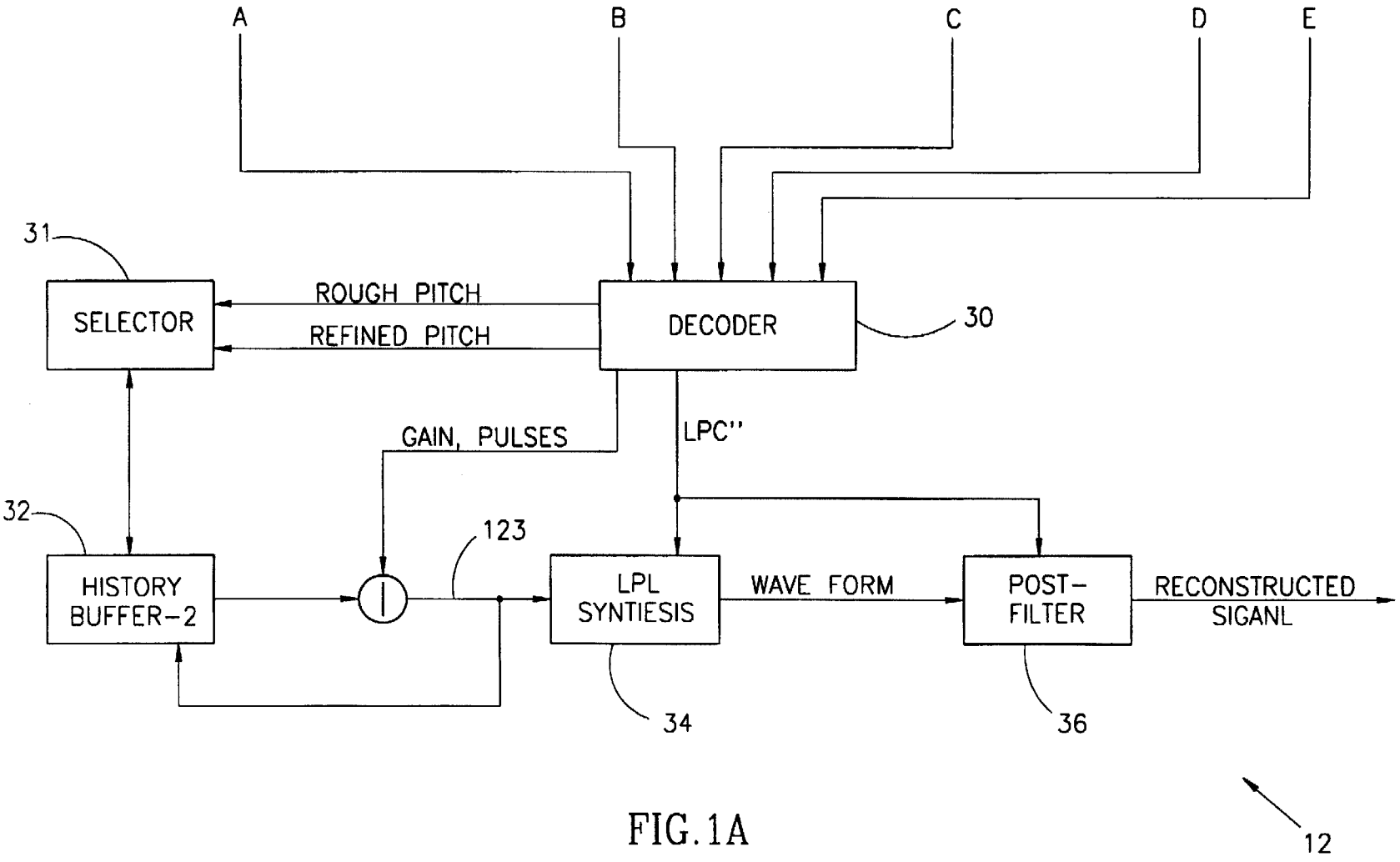

Reference is now made to FIG. 1 which illustrates, in block diagram format, the compression/decompression system of the present invention.

The present invention typically comprises a compression unit 10 for compressing the speech signal and a decompression unit 12 for reconstructing the compressed signal, both units operating on a personal computer (PC) to which no special hardware is added. The compression unit 10 includes a plurality of speech analyzing units, most of which require more than a nominal execution time. The decompression unit 12, on the other hand, includes only a few speech reconstruction units, only one of which requires more than a nominal execution time. Therefore, the decompression unit 12 can operate in real-time on a PC without the addition of special hardware.

The system of the present invention is useful in systems where it is desired to store a speech signal for later reconstruction. For example, it is useful in multi-media systems which augment a digitally stored block of text or an image with speech. For these systems, the time it takes to store the speech signal, while important, is not critical. However, since the speech is to be reconstructed and provided to the human ear, the reconstruction must occur in real-time.

The system of the present invention is now briefly described. The compression unit 10 typically comprises a framer 20, a short-term predictor filter 22, a two-step long-term predictor 24 and a multi-pulse analyzer 26. The framer 20 breaks an input digital signal into large frames, typically of 240 samples each. The short-term predictor filter 22 determines the spectral coefficients which define the spectral envelope of each large frame and, using the spectral coefficients, creates a noise shaping filter with which to filter each frame. The resultant signal, labeled 23, is known hereinafter as a "residual" signal.

The two-step long-term predictor 24 first analyses the residual signal and produces from it a rough estimate of the average pitch of the large frame. The predictor 24 then determines a long-term prediction which models the fine structure in the spectra of the speech in a subframe, typically of 60 samples. The resultant modelled waveform is subtracted from the signal in the subframe thereby producing a signal, labeled 27, known hereinafter as the "remnant" signal.

The multi-pulse analyzer 26 characterizes the shape of the remnant signal as a sequence of pulses at a plurality of locations and of quantized amplitudes. The pulse sequence is known hereinafter as a "remnant excitation" pulse sequence.

The long-term predictor 24 also computes an excitation signal 29, known hereinafter as the "residual" excitation signal, utilizing the remnant excitation pulse sequence and the long term prediction. The residual excitation signal models the residual signal.

The spectral coefficients, pitch estimate, long term prediction and pulses are typically, though not necessarily, encoded by the units which produce them and the coded values are provided to the decompression unit 12. The coded values represent a reduction by a factor of 8–10 in the size of a frame of the input speech signal, as will be detailed hereinbelow.

The decompression unit 12 typically includes a decoder 30, a selector 31, a history buffer 32 and an LPC synthesis unit 34 and a post-filter 36. The decoder 30 decodes the coded values received from the compression unit 10 and provides the resultant decoded data to the relevant units 31–36, as explained in more detail hereinbelow.

The history buffer 32 stores previous residual excitation signals up to the present moment and the selector 31 utilizes the decoded pitch estimate and long term prediction to select relevant portions of the data in the history buffer 32.

The selected portions of the data are added to the decoded remnant excitation pulse sequence and the result is stored in the history buffer 32, as a new residual excitation signal. The new residual excitation signal is also provided to the LPC synthesis unit 34 which, using the decoded spectral coefficients, produces a speech waveform. The post-filter 36 then distorts the waveform, also using the decoded spectral coefficients, to reproduce the input speech signal in a way which is pleasing to the human ear.

It will be appreciated that the compression unit 10 produces parameters so that the decompression unit 12 can build the residual excitation signal with minimal microprocessor execution time.

The operation of the compression/decompression system of the present invention will now be discussed in detail, with reference to FIG. 1 and to FIGS. 2–5 which are useful in understanding the operation of the system of the present invention. Except where otherwise noted, the methods utilized are described in the book *Digital Speech Processing, Synthesis and Recognition*, already incorporated herein by reference.

Although not illustrated, prior to operation by the system of the present invention, the speech signal is accepted and sampled, or digitized, using any suitable conventional speech digitization apparatus, such as a conventional analog-to-digital (A/D) converter.

The digitized speech is partitioned into large frames by framer 20. For example, in one embodiment, every 240 digitized samples are a single large frame.

Each large frame from framer 20 is sequentially passed to the short-term predictor 22. A linear prediction unit 40 in short-term predictor 22 determines the spectral envelope of the signal within each large frame. A noise shaper 42 in short-term predictor 22 utilizes the spectral coefficients determined by unit 40 for filtering the signal in the large frame thereby to uncorrelate the energy in the signal and to reduce the effect of the noise in the signal.

Figure 2:
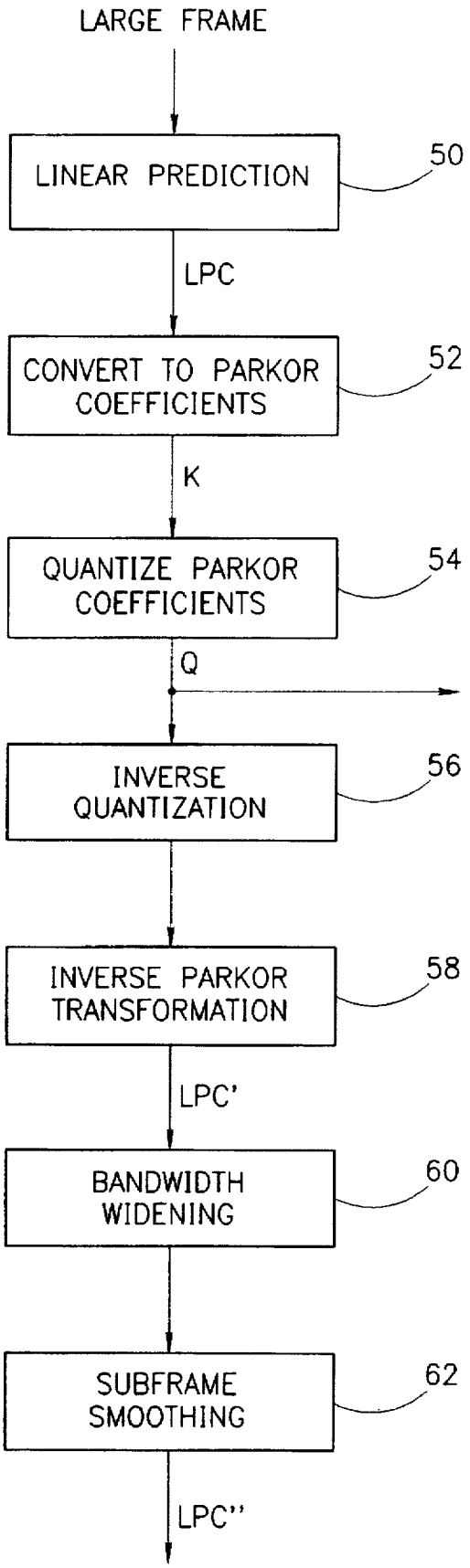
FIG. 2 is a flow chart illustration of the operations of a linear predictor forming part of the system of FIG. 1.

FIG. 2 illustrates one embodiment of the process performed by the linear prediction unit 40. First, in linear predication step 50, the digital signal in the large frame is operated on to generate eight linear prediction coefficients (LPC) which represent the spectral envelope of the large frame. To do so, a Hamming window is first applied to each large frame, after which nine autocorrelation coefficients are computed using Ridge regression. The autocorrelation coefficients are modified by a binomial window after which they are operated on by a Schur recursion unit, producing thereby the eight linear prediction coefficients.

It is noted that the prior art calculates 10–12 linear prediction coefficients and considers that eight coefficients do not accurately describe the spectral envelope. Therefore, the prior art, to the best knowledge of the inventor, failed to recognize that the original signal could be represented with a less accurate LPC model.

In step 52 the linear prediction coefficients LPC are converted to their corresponding Parkor coefficients K. The floating point Parkor coefficients K are then quantized (step 54) into quantized Parkor coefficients Q by non-linear scalar quantizers. Since the Parkor coefficients are not equally important, they are quantized to different numbers of bits, 31 in all, as follows:

| Quantized Parkor Coefficient | No. of Bits |
|---|---|
| 1 | 5 |
| 2 | 5 |
| 3 | 4 |
| 4 | 4 |
| 5 | 4 |
| 6 | 3 |
| 7 | 3 |
| 8 | 3 |

The quantized Parkor coefficients Q are then transmitted to the decompression unit 12, wherein the term "transmission" herein indicates communication or storage.

Since it is desired to have the compression unit 10 operate with the same coefficients as the decompression unit 12, the quantized Parkor coefficients Q are converted into LPC' coefficients, in steps 56 and 58 (inverse quantization and inverse Parkor transformation). The inverse quantization is simply a determination of the values of the quantized coefficients Q. A suitable inverse Parkor transformation is the Durbin-Levinson step-up recursion method.

In step 60 a bandwidth widening is performed. The bandwidth widening slightly changes the linear prediction coefficients LPC' so that the poles of the filter which they create move slightly towards the center of the complex unit circle. This smooths any sharp and unnatural peaks in the spectral envelope and gives a more realistic spectrum representation.

In subframe smoothing (step 62), a set of coefficients LPC" are generated for each of a plurality of subframes into which each large frame is to later be partitioned, since the transition between sets of coefficients LPC' for adjacent large frames may be sharp. For example, each large frame may be partitioned into four subframes of equal length. For the third and fourth subframes, the coefficients LPC" may be identical to the coefficients LPC' of the large frame to which they belong. For the first and second subframes, interpolated coefficients LPC" are generated by using a weighted average of the coefficients LPC' of the current large frame and of the preceding large frame, wherein the coefficients LPC' of the current large frame receive twice the weight of the coefficients LPC' of the preceding large frame.

The interpolated coefficients LPC" then undergo stability testing, using a suitable method such as the inverse of the Durbin-Levinson method. It is appreciated that the stability testing method need not be the inverse of the method employed in step 58. If stability testing indicates that an individual set of coefficients LPC" are unstable, then, for that subframe, the original (i.e. not interpolated) coefficients LPC' for the large frame to which the subframe belongs, are employed.

The linear prediction coefficients LPC", which are the same as the spectral coefficients described hereinabove, are then utilized by other elements of the compression unit 10 and the decompression unit 12.

The noise shaper 42 preferably takes into account characteristics of human perception of audio signals and, specifically, of human perception of speech signals. Thus, the noise shaper 42 is a filter using the coefficients LPC" generated in step 62. In the filter, the coefficients LPC" are adjusted such that, when the output of the noise shaper 42 is perceived by a human, the noise in the input signal is maximally masked by the speech itself.

For example, a suitable transfer function of a filter for this purpose is:

$$\frac{1-\Sigma a_i z^{-i}}{1-\Sigma a_i \alpha^i z^{-i}} \quad (1)$$

wherein the sum is performed for i=1 to 8, the $a_i$ are the individual coefficients LPC", $\alpha$ is a weighting factor typically of value 0.8, and $z^{-i}$ is a sample in the input digital speech signal i units before the present sample.

The noise shaper 42 typically filters the speech signal in accordance with the transfer function provided in equation 1. The result is the residual signal 23 which is provided to the two-step long-term predictor 24 as a "target vector". Herein, a signal and the line carrying the signal are given the same reference numeral for convenience.

Figure 3A:
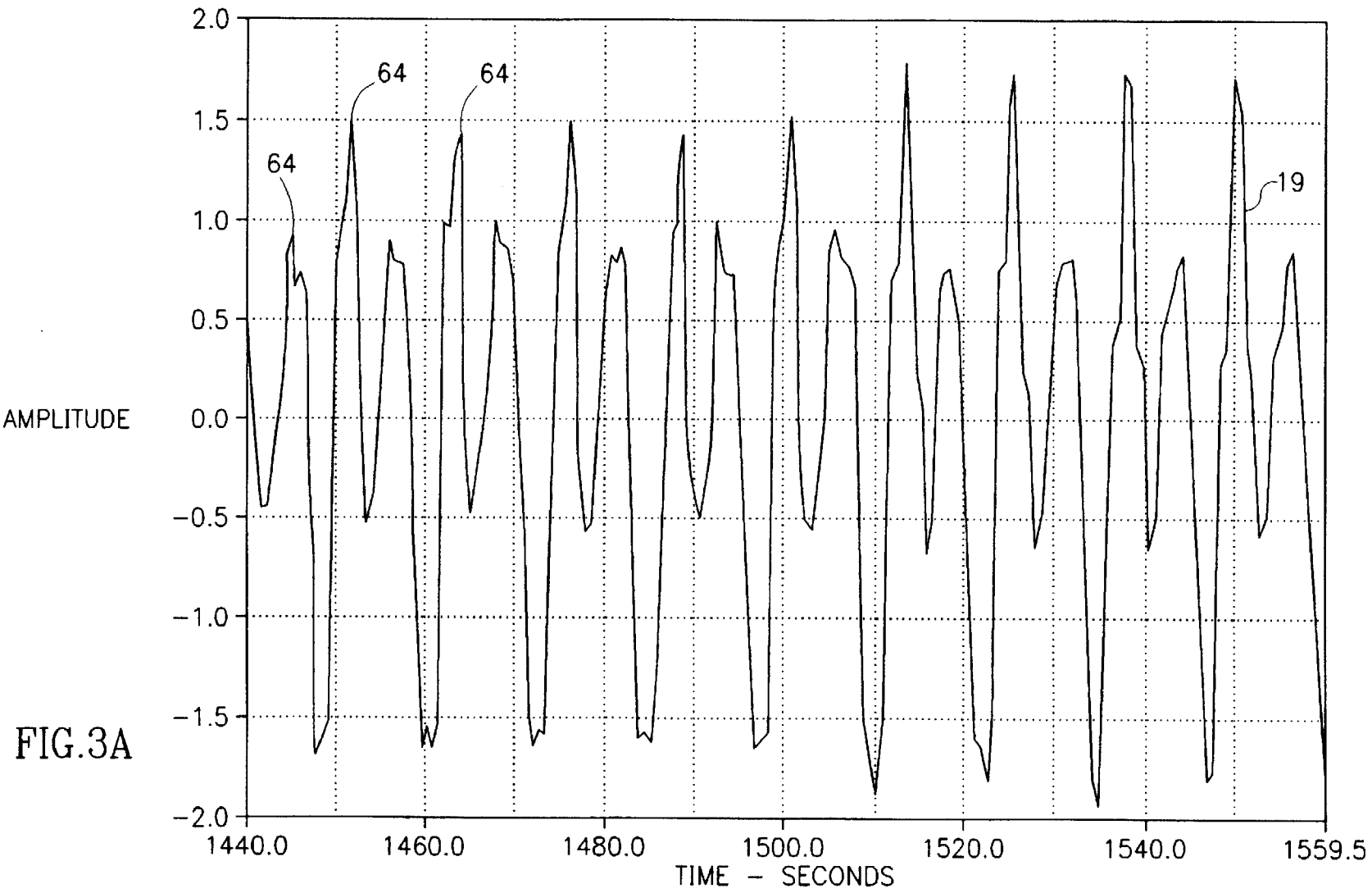
FIG. 3A is a graphical illustration of an input speech signal.
Figure 3B:
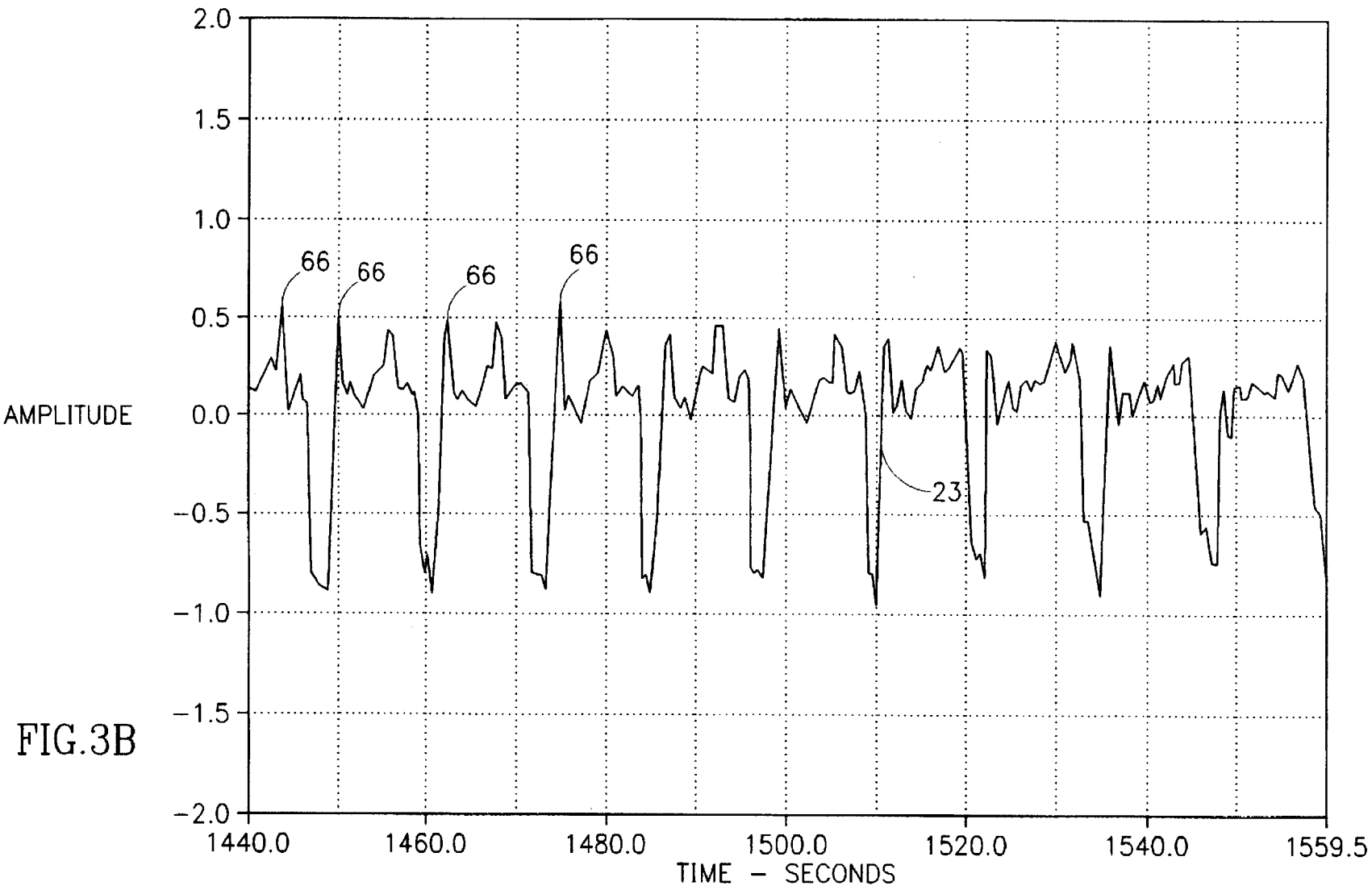
FIG. 3B is a graphical illustration of a speech signal after noise shaping.
Figure 3C:
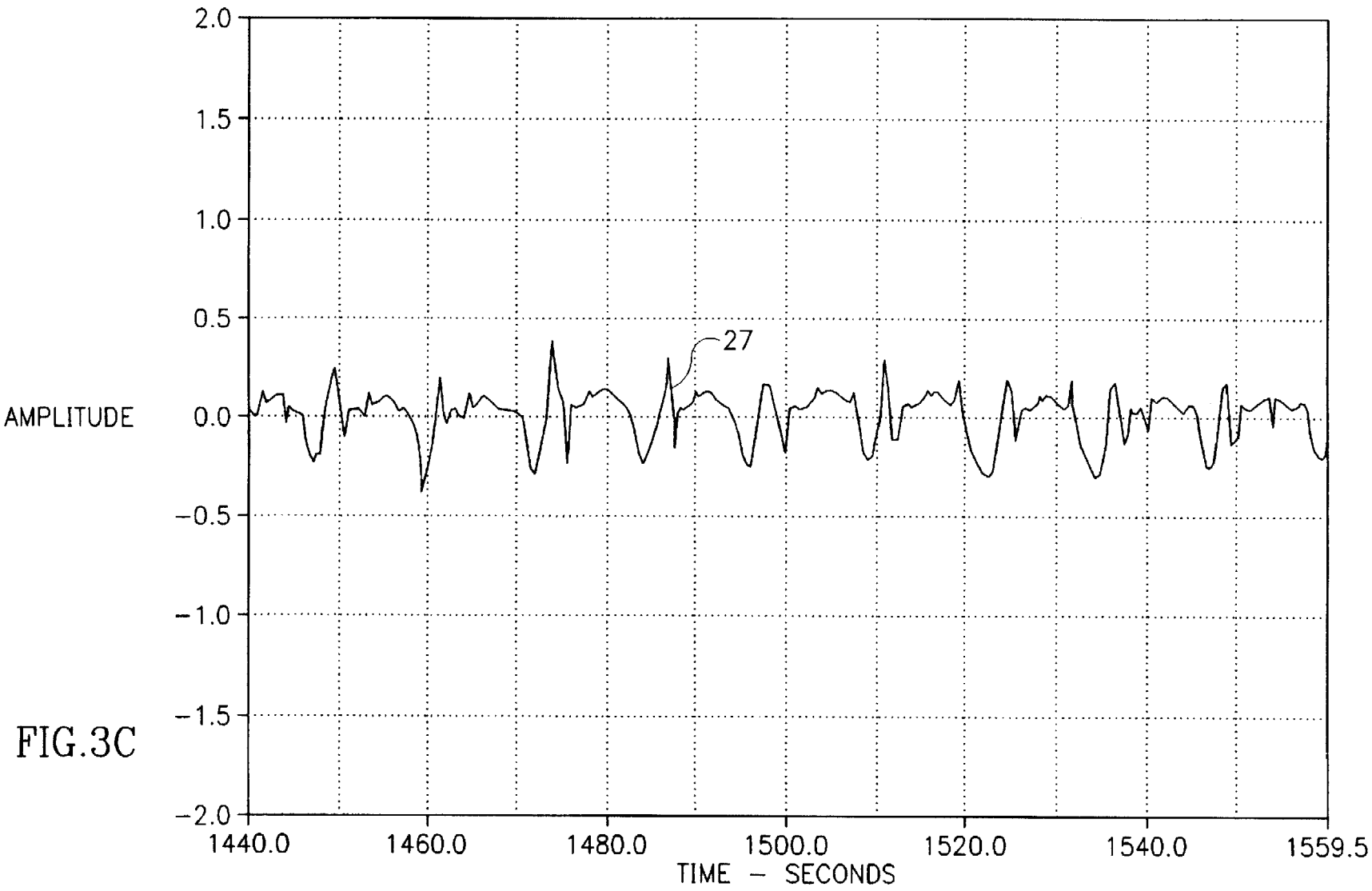
FIG. 3C is a graphical illustration of a speech signal after short- and long-term correlations have been removed.

An example of a many frame input speech signal 19 and its corresponding residual signal 23 are provided in FIGS. 3A and 3B. As can be seen, the speech signal has a plurality of repetitive spikes 64. The corresponding spikes, labeled 66, in the residual signal 23 of FIG. 3B have a much lower amplitude.

The spikes 64 typically are periodic and their frequency is known as the "pitch" of the speech. For the purposes of the discussion hereinbelow, the pitch is defined as the number of samples between any two spikes 64. It will be appreciated that the pitch varies slowly over time and therefore, must continually be determined. The maximum pitch value, corresponding to a low-pitched male, is typically 146 samples long. The minimum pitch value, corresponding to a high-pitched female, is typically 20 samples long.

The two-step long-term predictor 24 (FIG. 1) typically includes a framer 70, a pitch estimator 72 and its associated first history buffer 74 for performing the first step and a second order pitch predictor (or extractor) 76 and its associated second history buffer 78 for performing the second step.

As described in more detail hereinbelow, the framer 70 separates the large frame into four equal subframes, each of 60 samples long. The pitch estimator 72 roughly estimates the pitch of the large frame and encodes the value for output to the decompression unit 12. Since there is a limited range of pitch values, each rough pitch estimate value is given an index and the value of the selected index is the code value.

For each subframe, the pitch predictor 76 searches in the close vicinity of the rough pitch estimate to determine lags and gains of a second-order long-term predictor. The pitch predictor 76 then produces a signal, or waveform, which best matches the target vector of the subframe. The lag or gain in the pitch value is encoded for output to the decompression unit 12 and the matched waveform is subtracted from the target vector, via a subtractor 79. The resultant remnant signal 27, from which the short- and long-term correlations have been removed, is provided to the multi-pulse analyzer 26.

Specifically, the pitch estimator 72 works as follows: the first history buffer 74 is a first-in-first-out (FIFO) buffer which is as long as the maximum expected pitch length, such as 146 samples. Stored in the buffer 74 are residual signals from previous large frames. The target vector of the large frame is divided into two halves, each of which is cross-correlated with the data stored in the history buffer 74. For each half, an offset providing the largest cross-correlation result is defined as the rough pitch estimate RPITCH for that half. Any suitable correlation technique utilized for determining pitch, such as the normalized correlation method, can be utilized for the pitch estimator 72. The pitch estimator 72 encodes the two rough pitch estimates RPITCH as two 7 bit variables (covering the 126 possible pitch length values) and provides the RPITCH values to the pitch predictor 76.

The pitch predictor 76 operates on target vectors (residual signals 23) of the length of subframes, where for the first two subframes, it utilizes the first rough pitch estimate and for the second two subframes, it utilizes the second rough pitch estimate.

Figures 4A, 4B:
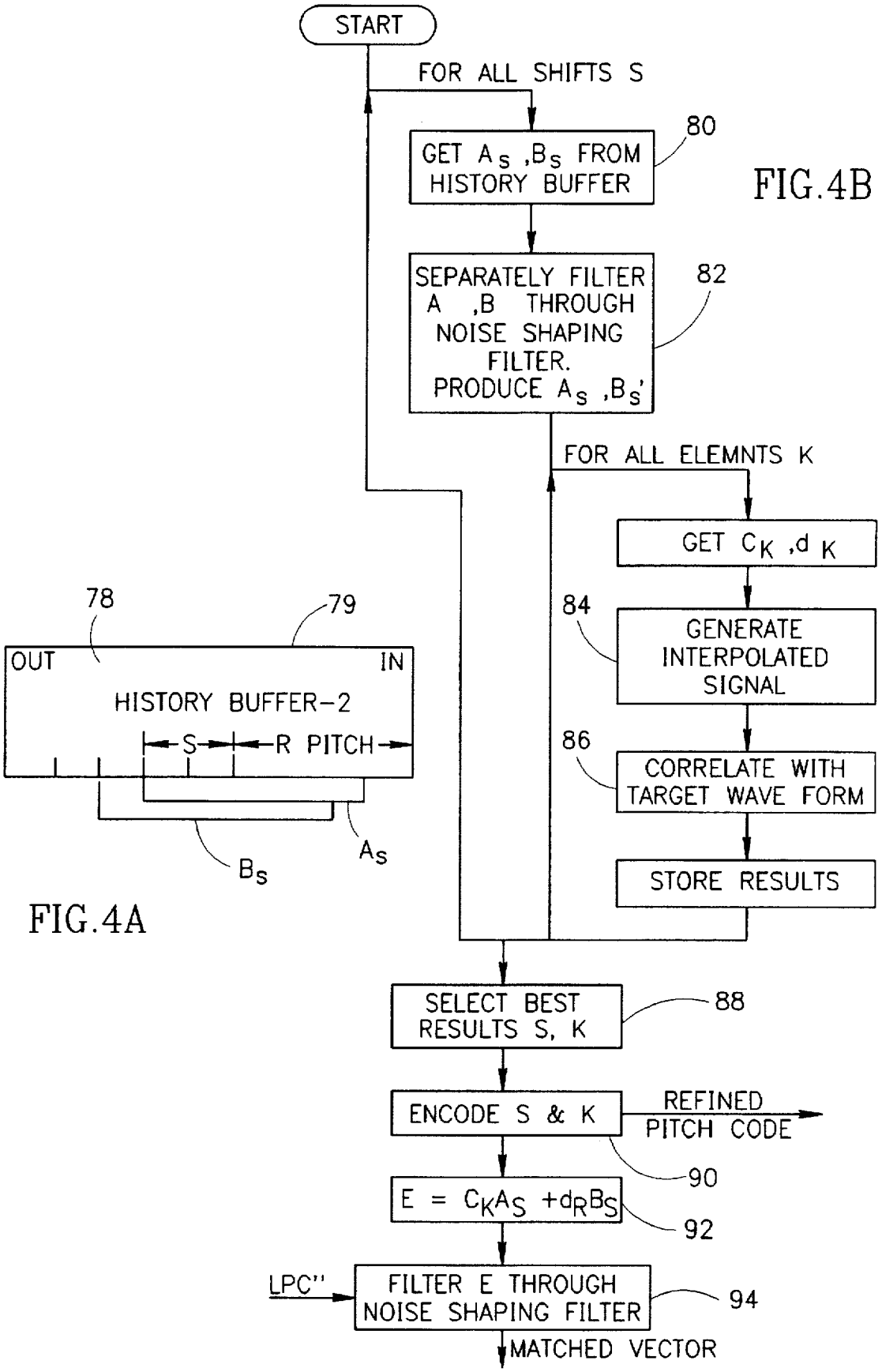
FIG. 4A is a schematic illustration of a history buffer forming part of the system of FIG. 1.
FIG. 4B is a flow chart illustration of the operations of a long-term pitch predictor forming part of the system of FIG. 1.

The second history buffer 78 is a FIFO buffer of 146 samples and has stored therein residual excitation signals from prior subframes, as described in more detail hereinbelow. The pitch predictor 76 is of second order and seeks to determine a more refined representation for the pitch than the rough pitch estimate RPITCH. To do so, it operates on a subframe and extends or shrinks the rough pitch estimate RPITCH by a few samples in each direction where, typically, the maximal shift is two samples. Thus, as shown in FIG. 4A, pitch predictor 76 retrieves a subframe starting at the sample which is RPITCH+s samples from an input end 79 of the history buffer 78, where s varies from −2 to 2. The result is a first residual excitation signal $A_s$.

Furthermore, since sampling is not exact, interpolation is performed and to that end, a second residual excitation signal $B_s$, of the same length as $A_s$ but shifted one sample earlier in the history buffer, is also retrieved. These operations form the first step, step 80, of the method performed by the pitch predictor 76 which is outlined in FIG. 4B. Specifically, for each of the possible shifts, s, the residual excitation signals $A_s$ and $B_s$ are retrieved from the second history buffer 78, after which, in step 82, they are separately filtered by a noise shaping filter, using the coefficients LPC", to produce filtered excitation signals $A'_s$ and $B'_s$.

The pitch predictor 76 not only refines the value for the pitch, but also determines the best interpolation given predetermined interpolation coefficients $c_k$ and $d_k$, where k varies from 0 to N, wherein N is typically 25. The coefficients $c_k$ and $d_k$ are typically empirically determined by analyzing a large sample of speech signals.

Thus, in step 84, interpolated signals are generated wherein, in one embodiment, each filtered excitation signal set, $A'_s$ and $B'_s$, is linearly combined with each set of interpolation coefficients. In this embodiment, each interpolated signal is defined as $c_kA'_s+d_kB'_s$. Each interpolated signal is separately correlated (step 86), via any suitable correlation method, with the subframe target vector and the results stored.

In step 88, the interpolated signal with the highest correlation is selected. The resultant values of the shift, s, and the index k, for each subframe, are encoded (step 90) for transmission. In this embodiment, the coded signal is a 7 bit index denoting the selected one of the 25 possible combinations of $c_k$ and $d_k$ combined with the five possible sizes (−2–+2) of the shift s.

In step 92 the selected combination is reproduced; specifically a "long-term prediction" excitation signal E is produced as follows:

$$E=c_kA_s+d_kB_s \tag{2}$$

In step 94, the excitation signal E is filtered by a noise shaping filter using the coefficients LPC". The resultant vector, denoted herein the "matched vector", is subtracted by subtractor 79 from the target waveform, producing thereby the remnant signal 27, an example of which, for the residual signal 23 of FIG. 3B, is provided in FIG. 3C. It is noted that the short term and long-term correlations have now been removed from the remnant signal 23. What remains are only those elements of the signal which are not similar to anything which has existed in previous input speech frames, and so the name "remnant" signal.

It is noted that for rough pitch values of less than the size of a subframe, the last RPITCH+s samples of the history buffer 78 do not produce a subframe of data. In this case, the samples retrieved from the history buffer are repeated as many times as is necessary to produce a subframe of data.

The multi-pulse analyzer 26 determines the multi-pulse excitation signal which most closely matches the subframe length remnant signal 27. In other words, the remnant signal 27 is modeled as a sum of a plurality of impulse responses, each occurring at a different location within the subframe.

Figure 5:
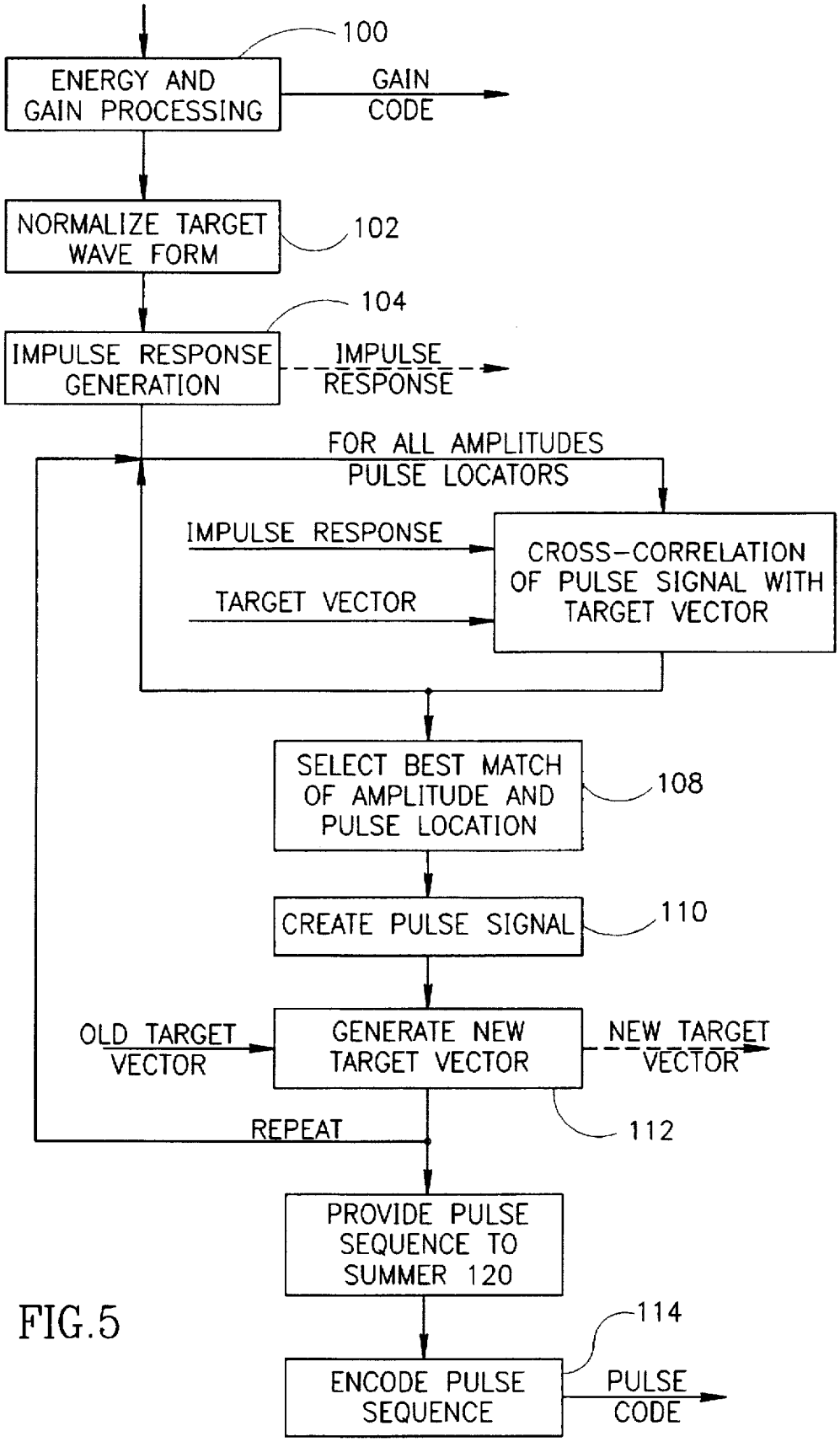
FIG. 5 is a flow chart illustration of the operations of a multi-pulse analyzer forming part of the system of FIG. 1.

FIG. 5 illustrates the operations of the multi-pulse analyzer 26. The energy of the remnant signal 27 is determined in step 100 by summing the squares of the values of each sample in the subframe. The value of the energy is a gain value which is quantized and the index of the quantized value, which in this embodiment is a four bit index, is transmitted. The gain is then utilized, in step 102, to normalize the remnant signal 27 (by dividing each sample in the subframe by the gain value) and to produce thereby a first target vector. The target vector is utilized in a number of later steps.

In step 104, the coefficients LPC" are utilized to produce an impulse response signal, which is the response of the noise shaping filter formed from the coefficients LPC" to a Dirac Delta function located at the first sample of the subframe.

In accordance with the present invention, in step 106 the target vector is cross-correlated, via any suitable correlation technique, with a pulse having one of four possible amplitudes, AMP1, AMP2, AMP3 and AMP4, and located at any of the possible sample locations. In one embodiment, AMP1, AMP2, AMP3 and AMP4 have the values +—0.25 and +—0.75. Each pulse is formed of the impulse response function shifted to a selected sample location having the selected amplitude.

The pulse providing the best match to the target vector is selected and its amplitude and location are stored, in step 108. In step 110 a waveform of the selected pulse is produced and, in step 112, subtracted from the target vector, thereby Steps 106–112 are performed a plurality of times for each subframe. In one embodiment, the steps 106–112 are performed seven times, wherein for three repetitions, the pulses are located in the lower half of the subframe and for four of them, the pulses are in the upper half of the subframe.

The resultant stored sequence of pulses of different amplitudes forms the remnant excitation pulse sequence. Finally, in step 114, the location of the pulses and their amplitudes are encoded for transmission to the decompression unit 12. In one embodiment, two bits are used to indicate the four possible amplitudes of each pulse, 18 bits are utilized to indicate the possible locations of the four pulses in the upper half of the subframe and 15 bits are utilized to indicate the possible locations of the three pulses in the lower half of the subframe. Thus, in this embodiment, 7×2+18+15=47 bits are utilized, per subframe, to encode the remnant excitation pulse sequence.

Figure 3D:
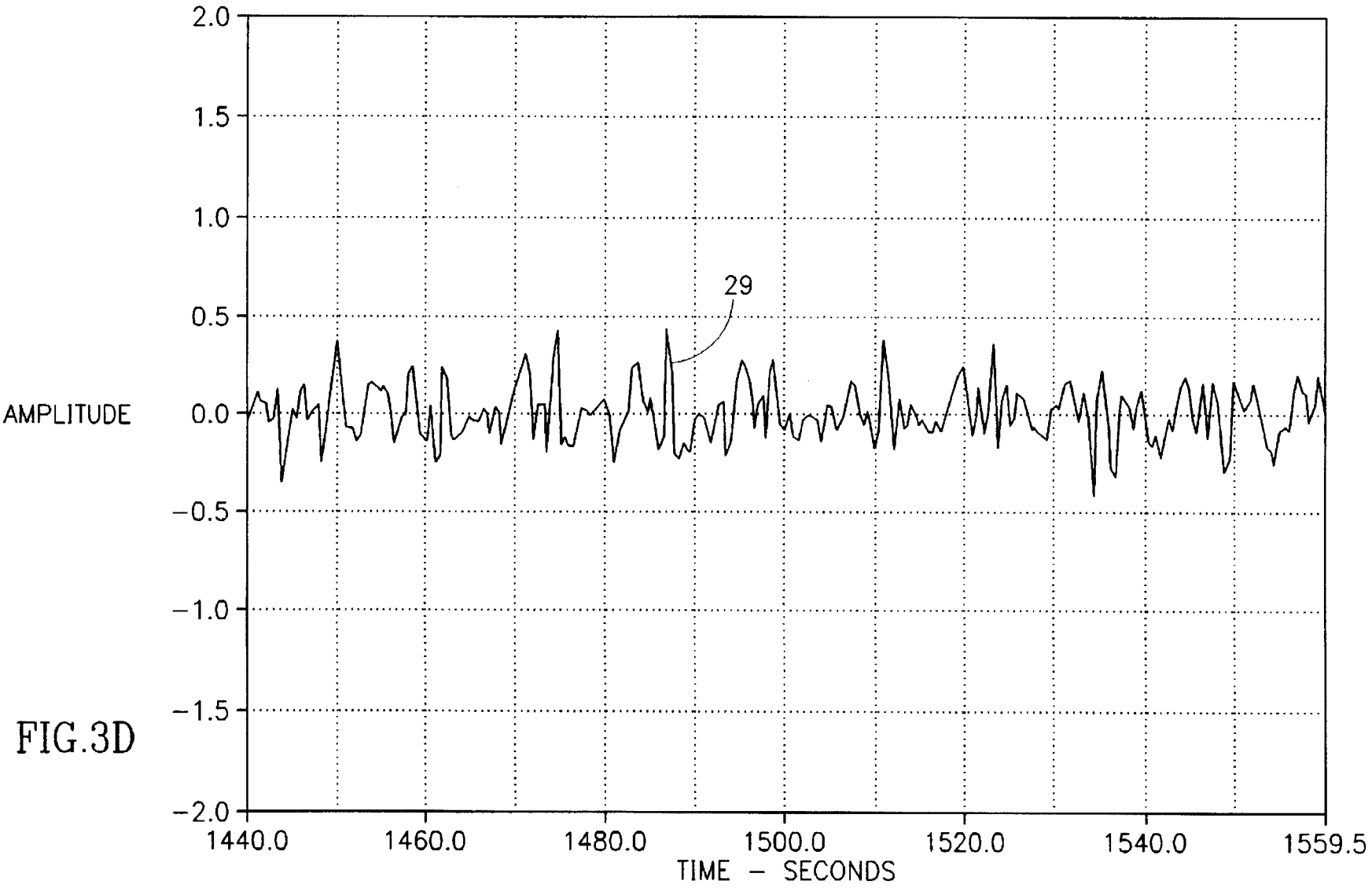
FIG. 3D is a graphical illustration of an excitation signal modeling the signal of FIG. 3B.

The remnant excitation pulse sequence is formed into a remnant excitation signal by placing pulses at the selected locations, wherein each pulse is multiplied by its corresponding amplitude and the gain. The remnant excitation signal is then provided to a summer 120 (FIG. 1), to be added to the long-term prediction excitation signal E (FIG. 4B) produced by the pitch predictor 76. The resultant residual excitation signal 29, illustrated in FIG. 3D, is placed into the beginning of the second history buffer 78, shifting the data stored therein and removing therefrom the oldest subframe.

Each large frame is compressed into 277 bits as follows: 31 bits describing the quantized Parkor coefficients Q, 7×2 bits for the rough pitch, 7×4 for the shift s and index k, 4×4 for the gain and 47×4 for the remnant excitation pulse sequence. For input speech of 8 bits per sample and 240 samples per large frame, the present invention represents a compression ratio of approximately 8:1.

The decoder 30 (FIG. 1) of the decompression unit 12 receives the coded parameters and decodes them. For the rough and refined pitch estimates, the gain and the remnant excitation pulse sequence, this involves looking up the codes in lookup tables. The lookup tables associate the received indices with the values they code. For the Parkor coefficients Q, the decoding involves performing steps 56–62 (FIG. 2) of the linear prediction method, producing thereby the same spectral coefficients LPC" which are utilized in the compression unit 10.

The selector 31 of decompression unit 12 retrieves a first residual excitation signal $A_s$ from the history buffer 32 (stored therein as described hereinbelow), starting at the sample which is the decoded RPITCH+s samples from the input end of history buffer 32. A second residual excitation signal $B_s$, shifted one sample earlier in the history buffer, is also retrieved. The residual excitation signals $A_s$ and $B_s$ are the same as those selected in the pitch predictor 76.

Utilizing the decoded ck and dk, the selector 31 produces the long-term prediction excitation signal E, as defined in equation 2 hereinabove. The new residual excitation signal 123, produced by adding, in a summer 122 (FIG. 1), the long-term prediction excitation signal E to a remnant excitation signal, formed by placing pulses at the selected locations, wherein each pulse is multiplied by its corresponding amplitude and the gain. The residual excitation signal 123 is then filtered by the LPC synthesis filter 34 whose result is then filtered by the post-filter 36. The new residual excitation signal 123 is also placed into the beginning of the history buffer 32, shifting the data stored therein and removing therefrom the oldest subframe.

The transfer function for the LPC synthesis filter 34 is:

$$\frac{1}{1+\Sigma a_i z^{-i}} \tag{3}$$

The transfer function for the post filter 36 is:

$$\frac{1+\Sigma a_i G^i z^{-i}(1-K_1)}{1+\Sigma a_i \beta^i z^{-i}} \tag{4}$$

where the $a_i$ are the coefficients LPC", G is typically 0.55, β is typically 0.55 and $K_1$ is the first Parkor coefficient.

The result is a reconstructed signal which approximates the input audio signal and which is produced within real-time.

It will be appreciated by persons skilled in the art that the present invention is not limited to what has been particularly shown and described hereinabove. Rather the scope of the present invention is defined by the claims which follow:

I claim:

1. A system for compressing and decompressing audio signals, the system comprising:

an audio signal compression unit for compressing an input audio signal into a collection of parameters, wherein said parameters are an amplitude limited, remnant excitation pulse sequence, wherein the amplitudes of each pulse of said remnant excitation pulse sequence are limited to a limited plurality of predefined amplitudes, a set of spectral coefficients and a set of pitch parameters comprising a rough pitch estimate and a second order correction to said rough pitch estimate; and a decompression unit for producing a residual excitation signal from said set of pitch parameters and said remnant excitation pulse sequence and for filtering said residual excitation signal with said spectral coefficients thereby to produce a speech waveform.

2. A system according to claim 1 and wherein said decompression unit comprises:

a first-in-first-out (FIFO) buffer for storing residual excitation signals;

a selector for selecting portions of said stored residual excitation signals, said set of pitch parameters being pointers to said portions, for reconstructing a reconstructed excitation signal from said portions of said stored residual excitation signals, for linearly combining said reconstructed excitation signal with a remnant excitation signal, formed at least from said remnant excitation pulse sequence, into a residual excitation signal, and for storing said residual excitation signal in said FIFO buffer; and a filter having said spectral coefficients as its parameters for filtering said residual excitation signal into said speech waveform.

3. A system according to claim 1 and wherein said decompression unit additionally comprises a post-filter which filters said speech waveform.

4. A system according to claim 1 and wherein said compression unit comprises:

a short-term predictor responsive to said input audio signal for determining eight spectral coefficients for creating a filter having said spectral coefficients as its parameters, and for filtering out short-term correlations from said input audio signal with said filter thereby to generate a residual signal; and a two-step long-term predictor, receiving said residual signal, for determining said pitch parameters, and for filtering out long-term correlations from said residual signal with said pitch parameters thereby to produce a remnant signal.

5. A system according to claim 4 and wherein said compression unit also comprises an amplitude limited multi-pulse analyzer for producing said remnant excitation pulse sequence from said remnant signal.

6. A system according to claim 5 and wherein said amplitude limited multi-pulse analyzer generates seven amplitude limited pulses and a gain to represent said remnant excitation pulse sequence.

7. A system according to claim 5 and wherein said compression unit comprises coding means for receiving the following parameters: said spectral coefficients, rough pitch estimate, second-order correction and remnant excitation pulse sequence and a gain, from said short-term predictor, said two-step long-term predictor and said multi-pulse analyzer, respectively, and for encoding said parameters, and said decompression unit comprises a decoder for decoding said coded parameters prior to decompressing them and prior to producing said speech waveform from said parameters.

8. A decompression unit for audio signals, the unit comprising:

a reception unit for receiving eight spectral coefficients, a set of pitch parameters comprising a rough pitch estimate and a second order correction to said rough pitch estimate, and an amplitude limited, remnant excitation pulse sequence;

a first-in-first-out (FIFO) buffer for storing residual excitation signals;

a selector for selecting portions of said stored residual excitation signals, said pitch parameters being pointers to said portions, for reconstructing a reconstructed excitation signal from said portions of said stored residual excitation signals, for linearly combining said reconstructed excitation signal with a remnant excitation signal, formed at least from said remnant excitation pulse sequence, into a residual excitation signal, and for storing said residual excitation signal in said FIFO buffer; and a filter operating with said spectral coefficients to filter said residual excitation signal into said speech waveform.

9. A unit according to claim 8 and wherein said decompression unit additionally comprises a post-filter which filters said speech waveform.

10. A method for compressing and decompressing audio signals, the method comprising the steps of:

compressing an input audio signal into a collection of parameters, wherein said parameters are an amplitude limited, remnant excitation pulse sequence, wherein the amplitudes of each pulse of said pulse sequence are limited to a limited plurality of predefined amplitudes, a set of spectral coefficients and a set of pitch parameters comprising a rough pitch estimate and a second order correction to said rough pitch estimate;

producing a residual excitation signal from said pitch parameters and said amplitude limited, remnant excitation pulse sequence; and filtering said residual excitation signal with said spectral coefficients thereby to produce a speech waveform.

11. A method according to claim 10 and wherein said step of producing includes the steps of:

selecting portions of stored residual excitation signals, said pitch parameters being pointers to said portions, reconstructing a reconstructed excitation signal from said portions of said stored residual excitation signals, linearly combining said reconstructed excitation signal with a remnant excitation signal, formed at least from said remnant excitation pulse sequence, into a residual excitation signal; and storing said residual excitation signal in said FIFO buffer.

12. A method according to claim 11 and further including the step of transferring said linear combination into said FIFO buffer.

13. A method according to claim 10 and further including the step of post-filtering the output signal of said step of filtering.

14. A method according to claim 10 and wherein said step of compressing comprises the steps of:

determining eight spectral coefficients;

creating a filter having said spectral coefficients as its parameters, filtering out short-term correlations from said input audio signal with said filter thereby to generate a residual signal;

determining said pitch parameters from said residual signal; and filtering out long-term correlations from said residual signal with said pitch parameters thereby to produce a remnant signal.

15. A method according to claim 14 and wherein said step of compressing further comprises the step of performing amplitude limited, multi-pulse analysis on said remnant signal thereby to produce said remnant excitation pulse sequence.

16. A method according to claim 15 and wherein said step of performing multi-pulse analysis produces seven pulses and a gain as a representation of said remnant excitation pulse sequence.

17. A method according to claim 14 and wherein said step of compressing comprises the step of encoding the following parameters: said spectrum, rough pitch estimate, second-order correction and remnant excitation pulse sequence and a gain and wherein said step of producing comprises the step of decoding said coded parameters.

18. A system for compression and decompression of audio signals, the system comprising:

an audio signal compression unit coupled to an input audio signal and having a remnant excitation pulse sequence output line, a spectral coefficient output line and a pitch parameters output line, wherein said audio signal compression unit compresses said input audio signal into a set of spectral coefficients, a set of pitch parameters comprising a rough pitch estimate and a second order correction to said rough pitch estimate, and an amplitude limited remnant excitation pulse sequence, wherein the amplitudes of each pulse of said pulse sequence are limited to a limited plurality of predefined amplitudes;

a decompression unit having a remnant excitation pulse sequence input line, a spectral coefficient input line and a pitch parameters input line and a speech waveform output line, wherein said decompression unit produces a residual excitation signal from said pitch parameters and said remnant excitation pulse sequence and filters said residual excitation signal with said spectral coefficients thereby to produce a speech waveform.

19. A system according to claim 18 and wherein said decompression unit comprises:

a first-in-first-out (FIFO) buffer for storing residual excitation signals;

a selector for selecting portions of said stored residual excitation signals based on said pitch parameters, for reconstructing said reconstructed excitation signal from said portions of said stored residual excitation signals, for linearly combining said reconstructed excitation signal with a remnant excitation signal formed at least from said remnant excitation pulse sequence into a residual excitation signal, and for storing said residual excitation signal in said FIFO buffer; and a filter having said spectral coefficients as its parameters for filtering said residual excitation signal into said speech waveform.

20. A system for compressing and decompressing audio signals, the system comprising:

an audio signal compression unit for compressing an input audio signal into a collection of parameters, wherein said parameters are an amplitude limited, remnant excitation pulse sequence, wherein the amplitudes of each pulse of said pulse sequence are limited to a limited plurality of predefined amplitudes, a set of spectral coefficients, and a set of pitch parameters; and a decompression unit for producing a residual excitation signal from said set of pitch parameters and said remnant excitation pulse sequence and for filtering said residual excitation signal with said set of spectral coefficients, thereby to produce a speech waveform.

21. An amplitude limited multi-pulse analyzer comprising:

an energy determiner for determining the energy in an input signal, for producing a gain from said energy and for normalizing said input signal by said gain a pulse determiner for cross-correlating a target vector, initially equivalent to said normalized input signal, with a multiplicity of pulses, said pulses being at each of the entirety of pulse locations and, at each location, having a limited plurality of predefined amplitudes, for selecting the pulse which most closely matches said target vector and for removing said pulse from said target vector, thereby to produce a new target vector.

22. A method for performing amplitude limited, multi-pulse analysis, the method comprising the steps of:

determining the energy in an input signal;

producing a gain from said energy;

normalizing said input signal by said gain;

cross-correlating a target vector, initially equivalent to said normalized input signal, with a multiplicity of pulses, said pulses being at each of the entirety of pulse locations and, at each location, having a limited plurality of predefined amplitudes;

selecting the pulse which most closely matches said target vector;

removing said pulse from said target vector, thereby to produce a new target vector;

repeating the steps of cross-correlating, selecting and removing for a predetermined number of times.

* * * * *